United States Patent [19]

Rice, Jr. et al.

[11] Patent Number: 4,999,672

[45] Date of Patent: Mar. 12, 1991

[54] COMPUTER CONTROL OF PHOTOCOPIERS

[75] Inventors: Owen Rice, Jr.; Bruce A. Joblonicky, both of Tampa, Fla.

[73] Assignee: Lex Systems Southeast, Tampa, Fla.

[21] Appl. No.: 523,100

[22] Filed: Aug. 15, 1983

[51] Int. Cl.[5] ..... G03G 21/00

[52] U.S. Cl. ..... 355/202; 355/204

[58] Field of Search ..... 355/3 R, 6, 14 C, 14 CU, 355/200, 202, 204

[56] References Cited

U.S. PATENT DOCUMENTS

| | | | |
|---|---|---|---|
| 3,252,620 | 5/1966 | Houle et al. | 222/2 |
| 3,373,653 | 3/1968 | Roberts et al. | 88/24 |
| 3,378,831 | 4/1968 | Metcalf | 340/274 |
| 3,427,441 | 2/1969 | Swords | 235/92 |
| 3,436,530 | 4/1969 | Faude et al. | 235/92 |
| 3,562,491 | 2/1971 | Branfield | 235/61.1 |
| 3,779,357 | 12/1973 | Haller et al. | 194/5 |
| 3,872,282 | 3/1975 | Long | 355/14 CU |
| 3,940,210 | 2/1976 | Donohue | 355/14 C |
| 3,971,919 | 7/1976 | Fantozzi | 235/92 |
| 3,974,363 | 8/1976 | Malinich | 239/925 |
| 3,989,371 | 11/1976 | Valentine | 355/14 |
| 3,989,930 | 11/1976 | Sohm | 235/92 |
| 4,026,642 | 5/1977 | Tanaka et al. | 355/1 |
| 4,054,380 | 10/1977 | Donohue et al. | 355/14 |
| 4,173,408 | 11/1979 | Stewart | 355/1 |
| 4,179,212 | 12/1979 | Lahr | 355/14 |
| 4,190,350 | 2/1980 | Donohue et al. | 355/14 |
| 4,198,680 | 4/1980 | Gray, Jr. | 235/302 |

OTHER PUBLICATIONS

IBM Technical Disclosure Bulletin, vol. 15, No. 9, Feb. 1973.

IBM Technical Disclosure Bulletin, vol. 15, No. 12, May 1973.

IBM Technical Disclosure Bulletin, vol. 17, No. 11, Apr. 1975.

IBM Technical Disclosure Bulletin, vol. 19, No. 4, Sep. 1976.

*Primary Examiner*—Fred L. Braun

*Attorney, Agent, or Firm*—Webb, Burden, Ziesenheim & Webb

[57] ABSTRACT

An interface device for connecting a programmable computer to one or more photocopiers and translating computer logic to line signals to the photcopiers and transmitting line signals from the photocopiers to the computer.

6 Claims, 3 Drawing Sheets

COMPUTER CONTROL OF PHOTOCOPIERS

BACKGROUND OF THE INVENTION

Photocopiers are available in many varieties, from inexpensive small machines that simply make satisfactory copies slowly, to expensive and elaborate machines that make large numbers of copies quickly and, at the same time, reduce or enlarge the image, print it in color or black and white on one or both sides of various kinds of paper, and then collate and staple the steps of paper.

High-speed copiers are growing more productive, but are also growing more expensive. At the same time machine rental costs are rising, the cost of paper, supplies, floor space and labor (secretaries' or operators' salaries and related costs) are also rising. Additionally, these machines are larger and faster; so they consume more of these ever-more-expensive supplies faster. The costs associated with simpler machines, commonly called "convenience copiers", are economically absorbed into overhead. There may be no need to monitor these costs.

Monitoring, especially of more elaborate machines enhances accountability and control over the duplicating function. When volumes are low, a manual system of writing down the user's name or department, the account to be charged and the number of copies made, is satisfactory. Automated monitoring, however, is more reliable and better suited for high volume operations.

Counting devices with limited capability have been available for many years. They are all basically one of two types of systems, a cartridge, key, or card-activating counter; or, more recently, an electronic recorder.

Cartridge, key or card-activated counters limit access and use of a copier to one holding such a cartridge, key or card. Usually the number of copies is recorded by a counter.

Electronic recorders can be more elaborate. Some use a card or badge to control access to the copier. On certain types an account number can be entered on a keyboard and the number of copies made in that transaction is recorded against that account. The transaction data can be stored in a memory or on some medium, such as diskette or magnetic or paper tape. Periodically, the medium is processed, usually at some service bureau, to generate a report of copies made, account by account.

Several such devices are commercially available. None transmits data directly to a computer. Their users send the recording media (usually magnetic tape) to the service bureau, where the data is processed and printed. After the user receives the printed reports from the service bureau, it must batch and enter the data into its management information systems.

Some devices are cartridge, key or card activated, and so can record only the total number of copies, cumulatively tallied for a particular cartridge, key or card. In order to distribute copying charges among many clients or jobs or departments, each user must make out some form of charge slip for each tally of copies and an accounting staff must control all the charge slips and enter each one correctly to the proper account. The inconvenience to all users is aggravated by weaknesses they perceive in the internal controls inherent in such a system.

One or two devices can capture usage information and charges by client or department or job, but it is difficult to change the usage data to be gathered, and it is next to impossible to verify the data required. An accounting staff must still enter all the transactions into the accounting system.

Computer controlled photocopiers have been proposed in which a control program is made a part of the photocopier machine. Such apparatus is disclosed in Donahue U.S. Pat. No. 3,940,210 of Feb. 24, 1976, and Stewart U.S. Pat. No. 4,173,408 of Nov. 6, 1979. Those machines use a computer to control the successive operations of the copier in making copies.

SUMMARY OF THE INVENTION

Nearly all photocopiers now being made have connections for a device to control the copier and count the copies made. Those devices, however, control the copier through line signals, as opposed to the binary logic signals of a computer. Our invention makes it possible to connect an existing programmable computer with such a copier so as to obtain both computer controlled access to the copier and computer controlled operations of counting, pricing and billing for usage of copier attachments or accessories and for copies made thereon and comprehends such a process. Our invention also comprehends an interface device to be connected between a programmable computer and one or more photocopiers so as to transmit logic signals from the computer to the copiers and to transmit line signals from the copiers to the computer.

DESCRIPTION OF PREFERRED EMBODIMENT

Figure 1:
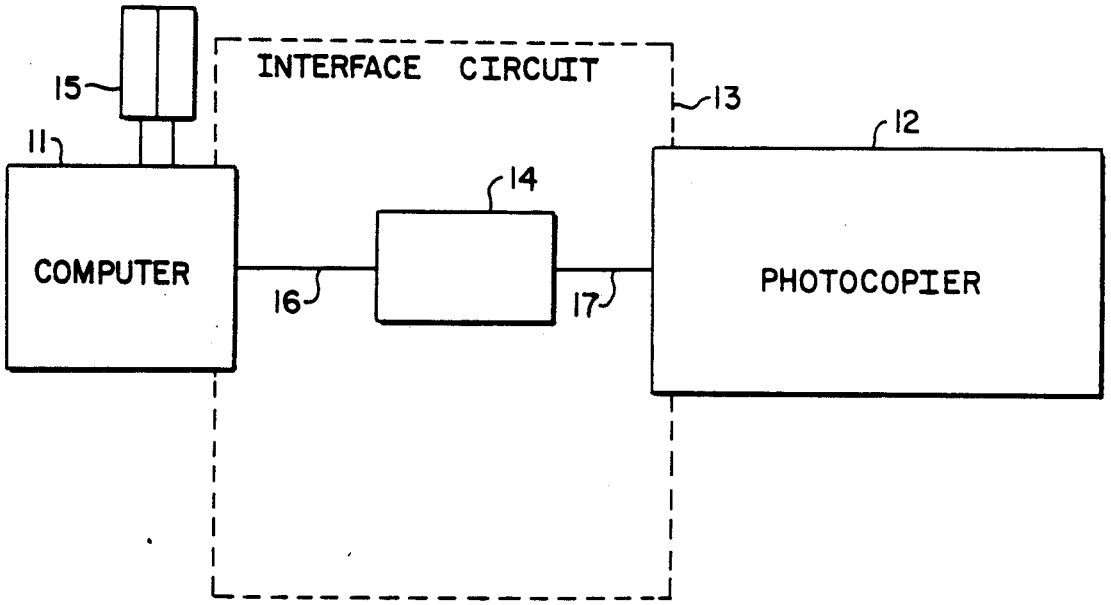
FIG. 1 is a block diagram of our apparatus connected between a computer and a photocopier.

In FIG. 1 our apparatus 13 is shown connected between programmable computer 11 and a copier or like machine 12. Our apparatus 13 comprises an interface circuit 14 to be described hereinafter and a storage medium 15 containing a program. Storage medium 15 is preferably memory, tape or diskette. Interface circuit 14 is connected to computer 11 by multiple conductor cable 16 and to photocopier 12 by multiple conductor cable 17. Storage medium 15 is preferably in the same housing as computer 11.

Figure 2:
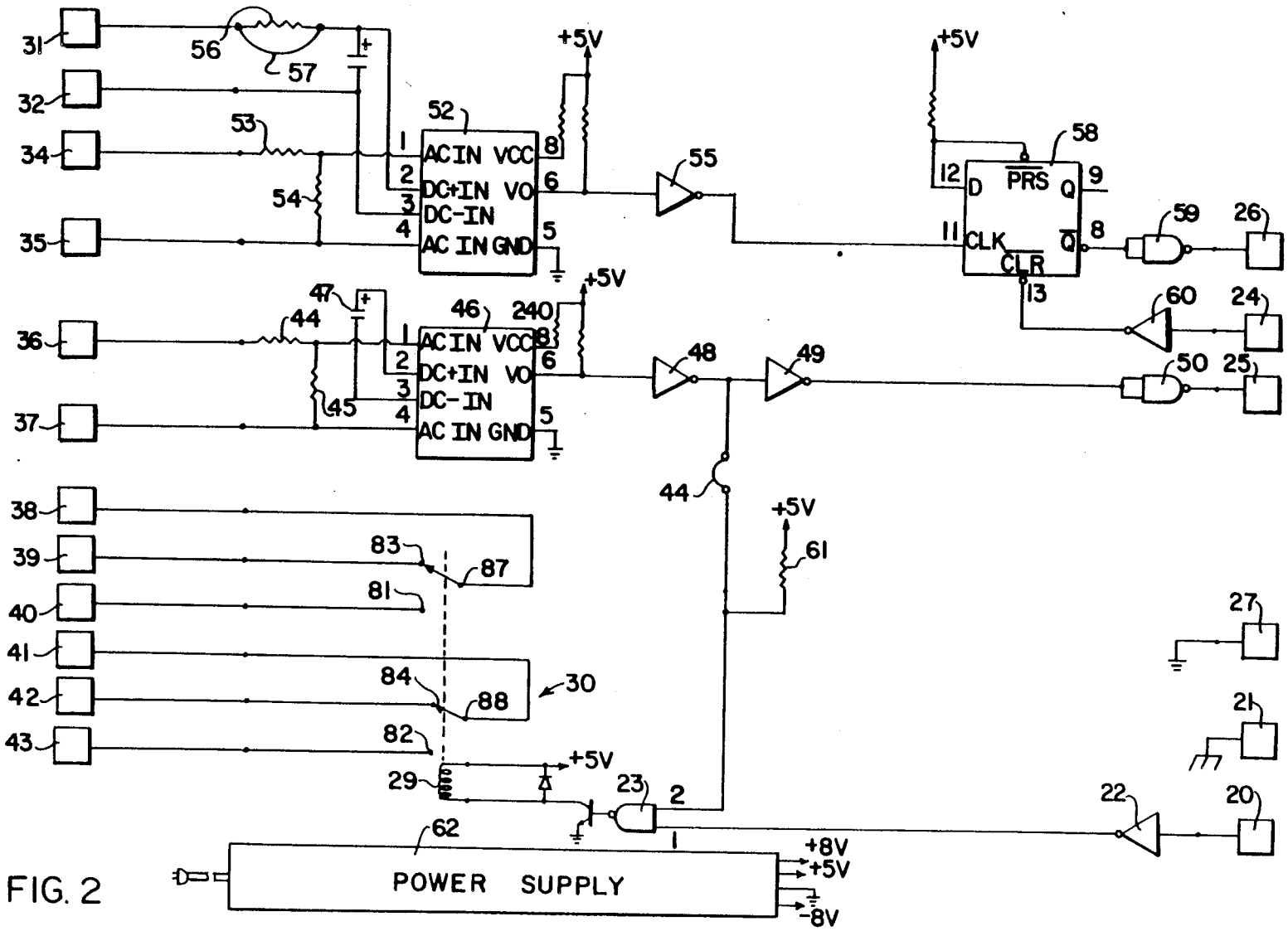
FIG. 2 is a circuit diagram of our interface apparatus shown in FIG. 1.

As is shown in FIG. 2, our interface circuit 14 has terminals 20, 21, 24–27 inclusive which connect through multiconductor cable 16 with like terminals of computer 11 and terminals 31, 32 and 34–37 inclusive which connect through multiconductor cable 17 with appropriate terminals of photocopier 12. Terminals 38–43 inclusive connect through cable 17 with the external control input to photocopier 12, although not all photocopiers require connectors with all of those terminals. The control of the photocopier is effected by a computer signal received on terminal 20 of interface 14. That terminal is connected in interface circuit 14 to the input of line receiver 22, the output of which is applied as logic 0 to one input of dual peripheral driver 23. The output of that driver is applied through to the coil 29 of relay 30. That relay as shown comprises a double pole-double throw switch. Its armature carries a movable contact 88 which can make a contact through a fixed contact 84 connected to terminal 42 or to a second fixed contact 82 connected to terminal 43. Contact 88 itself is connected to terminal 41. Relay 30 as shown is also provided with a second identical set of contacts 87, 83 and 81 connected to terminals 28, 39 and 40, which may be required by some copiers.

Terminal 21 is a protective ground connected to the interface housing, and terminal 27 is the signal ground.

A power line frequency voltage signal from he copier after it is turned on is received on interface terminals 36 and 37 which connect through an attenuator comprising series resistor 44 and shunt resistor 45 with pins 1 and 4, the "AC In" pins of AC-DC to logic interface 46. Pins 2 and 3, the "DC In" terminals, are unused and are by-passed by a capacitor 47. Pin 6, the output, is connected to input of Schmitt trigger inverter 48, the output of which is connected to the input of a second Schmitt trigger inverter 49 and to the second input of dual peripheral driver 23 through jumper 44. The output of inverter 49 is connected to terminal 25 through line driver 50.

Our interface circuit 52 is provided with two sets of terminals to receive either AC or DC copy signals from a photocopier. Terminals 31 and 32 receive DC signals, usually 24 volts, and are connected to the DC input pins 2 and 3 of AC-DC to logic interface 52 through voltage dropping resistor 56 which may be by-passed by jumper 57. Terminals 34 and 35 receive power line frequency voltage AC signals from a copier and are connected to the AC input pins 1 and 4 of the interface 52, again through an attenuator having a series resistor 53 and shunt resistor 54.

Interface devices 46 and 52 are opto-isolators in which the input signals control a light-emitting diode the light from which is converted to a voltage by a photo transistor.

The output of interface device 52 is connected to the input of Schmitt trigger inverter 55. The output of inverter 55 is connected to clock pin 11 of "D" flip-flop 58. "$\overline{Q}$" pin 8 of that flip-flop is connected through line driver 59 to terminal 26 of our device. Terminal 24 of our device is connected through line receiver 60 or "clear" pin 13 of flip-flop 58. Power supply 62 supplies the DC voltages required by our interface apparatus; 5 volts and 8 volts above ground and 8 volts below ground.

OPERATION OF PREFERRED EMBODIMENT

When a copier enable signal (DTR) of RS232 C voltage level is applied by the computer to terminal 20 of our apparatus that signal is converted by line receiver 22 to a logic 0. That logic 0 is applied to one input terminal of dual driver 23 causing the output of driver 23 to energize coil 29 of relay 30 so as to close the circuit between terminals 41 and 43. All copiers have their power switched on and off by some enabling signal which must be brought to appropriate copier terminals. In our apparatus those copier terminals are connected through cable 17 to one or both sets comprehended in terminals 38–43 inclusive. Some copiers require that a power line voltage circuit be completed through a relay such as relay 30; others require that a connection to the copier direct current ground be made or broken. Still others require that the enabling relay, such as relay 30, be switched to the "enable" state when the copier power is turned off. The closing of the contacts between terminals 41 and 43 and/or the closing of the contacts between terminals 38 and 40 turn on the photocopier 12. When that happens the AC line voltage on the copier appears at terminals 36 and 37 and a portion of that voltage is impressed on terminals 1 and 4 of interface device 46. That voltage causes output terminal 6 to go to logic 0. That level is inverted by inverter 48 and applied to the second input of dual driver 23. As long as the copier power is on, relay 30 is controlled by the signal on terminal 20 of our device.

If the voltage on terminals 36 and 37 is removed the voltage on pin 6 goes high. That signal is inverted by Schmitt trigger inverter 48 and the inverted signal is applied to pin 2, the second input of dual peripheral driver 23. Relay 30, therefore, is in the "on" position, regardless of the signal on terminal 20. Should our apparatus be connected to a copier that does not provide a line voltage signal, jumper 44 is removed. Pin 2 of dual peripheral driver 23 is then held at a logic "high" level by DC voltage supplied through resistor 61.

The signal from inverter 48 is inverted again by inverter 49 so as to drive line driver 50, the output of which appears on terminal 25 as a "copier on" signal (CTS).

When a copy is being made by the copier it applies either an AC signal to terminals 34 and 35 of our interface circuit or a DC signal to terminals 31 and 32, depending on the copier. Either type of signal actuates logic interface 52 which generates a logic 0 signal on its output terminal 6. Inverter 55 inverts that signal to a positive-going signal which is transmitted to clock terminal 11 of "D" flip-flop 58. Pin 8, the "Q" output, goes low to signal that a copy has been made, and that signal is translated to RS 232 C signal level by line driver 59 and appears as "copy" signal (DSR) on terminal 26 of our apparatus. That signal stays low until the computer sends a "copy clear" pulse (RTS) to terminal 24 of our apparatus, which signal is translated to a logic 0 signal by line receiver 60 and is applied by it to "clear" terminal 13 of "D" flip-flop 58.

TABLE OF COMPONENTS

| Reference Characters | Designation | Description | Manufacturer |
|---|---|---|---|
| 22, 60 | MC 1489P | Quad RS232-C Line Receiver | Motorola |
| 23 | SN 75451 | Dual Peripheral Driver | Texas Instruments |
| 50, 59 | MC 1488P | Quad RS232-C Line Driver | Motorola |
| 48, 49, 55, 56 | SN 74LS14N | Hex Schmitt Trigger Inverter | Texas Instruments |
| 58 | SN 74LS74AN | D Flip-Flop | Texas Instruments |
| 46, 52 | HCPL 3700 | AC/DC to Logic Interface | Hewlett-Packard |

Figure 3:
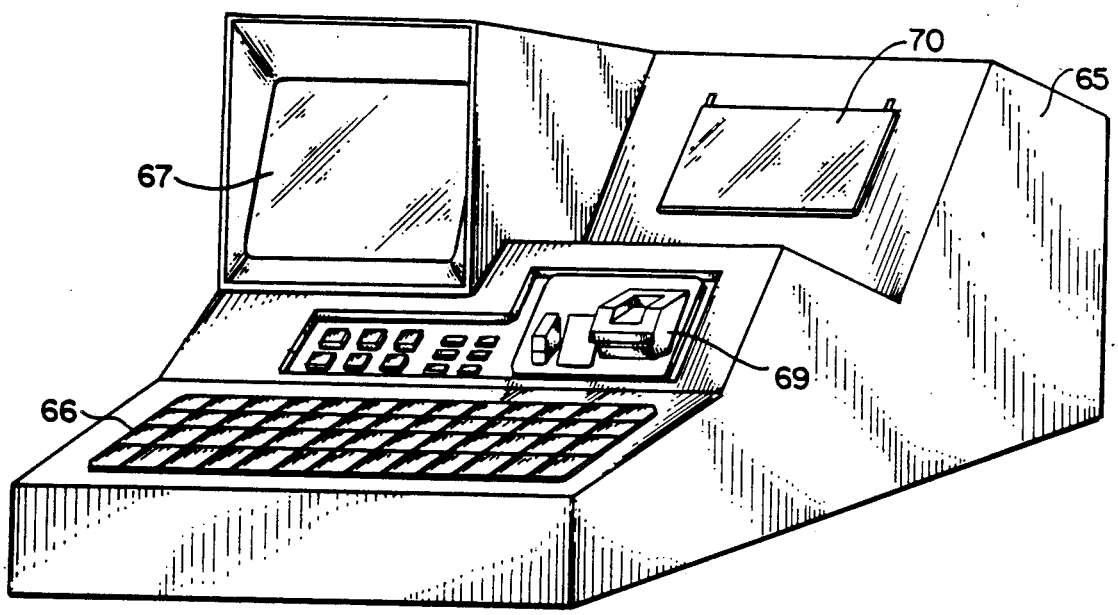
FIG. 3 is an isometric view of our apparatus.

Our interface circuit 14 is connected with console 65, FIG. 3, which includes a keyboard 66, a display screen 67, optionally a magnetic card reader 69, and a drive for the tape or diskette memory 15 which is accessible through panel 70. The above mentioned components are conventional and operate in the conventional way. The console also contains a micro-processor chip. Memory 15 comprises a two-section program, one for the computer 11 and one for the copier 12. The first section controls the nature of the data to be entered by a user of the copier prior to such use. The second section controls the copier and counts copies made and the copier accessary usage.

The data control section of the program uses field definition parameters supplied by a separate data file. This allows the data to be entered and the screen format to be varied for each user without modifying the program each time.

In addition to the field definitions, a pricing table is used to compute charges for use of copier accessories and for copies made according to a simple cut-off number (breakpoint pricing) or a price per copy algorithm.

Once the operator has entered all the required data on keyboard 66, the program transfers control to the copier control section. This section is different for each UART chip used in the micro computers. From the above it will be seen that the aggregate pricing of copies ordered by each user can readily be billed to each user by directly connecting the computer with a suitable print-out device. The counting, pricing and billing of copies made and copier accessory usage may be carried out by computer, diskette and printer at hand, and be carried out through a modem by such apparatus at another location.

In the foregoing specification, we have set our certain preferred practices and embodiments of our invention, however, it will be understood that this invention may be otherwise embodied within the scope of the following claims.

We claim:

1. Interface apparatus for connecting a computer having binary logic signalling with a photocopier or the like not integral with said computer having line signalling so that said computer controls the enabling of said copier comprising:

a. first terminals for receiving said logic output signals from said computer, second terminals for transmitting line input signals to said copier and means for converting said logic output signals to said line input signals connected between said first terminals and said second terminals, b. third terminals for receiving said line output signals from said copier responsive to said logic output signals from said computer, fourth terminals for transmitting logic input signals to said computer and means for converting said line output signals to said logic input signals connected between said third terminals and said fourth terminals, c. means for storing said logic input signals from means (b);

d. means for resetting said logic input signal storage means (c). and e. cable means for connecting said interface terminals to said computer and said copier terminals respectively.

2. Apparatus of claim 1 including relay means having a coil connected to receive line input signals from means (a) of claim 1 and contacts in said copier power input.

3. Apparatus of claim 1 in which means (a) of claim 1 have an input from the output of means (b) of claim 1.

4. Apparatus of claim 1 in which means (b) of claim 1 are isolating means.

5. Apparatus of claim 1 in which means (b) of claim 1 comprise an opto-coupler.

6. Apparatus of claim 1 in which means (c) of claim 1 comprise a "D" flip-flop.

* * * * *

UNITED STATES PATENT AND TRADEMARK OFFICE

CERTIFICATE OF CORRECTION

PATENT NO. : 4,999,672

DATED : March 12, 1991

INVENTOR(S) : Owen Rice, Jr., Bruce A. Joblonicky

It is certified that error appears in the above-identified patent and that said Letters Patent is hereby corrected as shown below:

Column 1 Line 11 "steps" should read --sets--.

Column 1 Line 33 "systems," should read --systems;--.

Column 2 Line 2 "required" should read --reported--.

Column 2 Line 41 before "programmable" insert --a--.

Column 3 Line 4 "28" should read --38--.

Column 3 Line 8 "he" should read --the--.

Column 3 Line 41 "or" should read --to--.

Column 5 Line 27 "our certain" should read --out certain--.

Signed and Sealed this

Tenth Day of November, 1992

*Attest:*

DOUGLAS B. COMER

*Attesting Officer*

*Acting Commissioner of Patents and Trademarks*